US005275142A

United States Patent [19]

Kapellen et al.

[11] Patent Number: 5,275,142

[45] Date of Patent: Jan. 4, 1994

[54] AIR-FUEL RATIO OPTIMIZATION LOGIC FOR AN ELECTRONIC ENGINE CONTROL SYSTEMS

[75] Inventors: Daniel R. Kapellen, Lisle; Nick Dicosola, North Aurora, both of Ill.

[73] Assignee: Gas Research Institute, Chicago, Ill.

[21] Appl. No.: 899,379

[22] Filed: Jun. 16, 1992

[51] Int. Cl.[5] ..... F02D 41/14

[52] U.S. Cl. ..... 123/436

[58] Field of Search ..... 123/352, 436, 419; 364/431.05

[56] References Cited

U.S. PATENT DOCUMENTS

| | | | |
|---|---|---|---|
| 3,789,816 | 2/1974 | Taplin et al. | 123/436 |
| 4,064,846 | 12/1977 | Latsch et al. | 123/436 |
| 4,140,083 | 2/1979 | Frobenius | 123/436 |
| 4,161,162 | 7/1979 | Latsch et al. | 123/435 |
| 4,172,433 | 10/1979 | Bianchi et al. | 123/436 |
| 4,344,140 | 8/1982 | Leung | 123/478 X |
| 4,377,143 | 3/1983 | Hamburg | 123/436 X |
| 4,617,892 | 10/1986 | Staerzl | 123/436 X |

*Primary Examiner*—Tony M. Argenbright
*Attorney, Agent, or Firm*—Gifford, Groh, Sprinkle, Patmore and Anderson

[57] ABSTRACT

An air-fuel optimization logic for an electronic engine control system for optimizing the efficiency of a heat engine. The engine control system has a governor generating fuel command signals to maintain speed of the engine at a desired speed, means for generating a reference air-fuel ratio signal, means responsive to the fuel command signal and the air-fuel ratio signal for supplying air to the engine, and means responsive to the fuel command signal for supplying fuel to the engine. The air-fuel optimization logic has means responsive to a change in the fuel command signal to generate an optimized air-fuel ratio offset signal which when summed with the a reference air-fuel ratio signal produces an optimized air-fuel ratio signal. The air-fuel optimization logic increments the reference air-fuel ratio signal to find a lean offset and decrements the reference air-fuel ratio signal to find a rich offset. The lean and rich offsets are averaged to generate the optimized air-fuel ratio offset.

30 Claims, 5 Drawing Sheets

AIR-FUEL RATIO OPTIMIZATION LOGIC FOR AN ELECTRONIC ENGINE CONTROL SYSTEMS

BACKGROUND OF THE INVENTION

I. Field of the Invention

The invention is related to electronic control system for controlling the rate at which air and fuel are supplied to a heat engine and, in particular, to an air-fuel ratio optimization logic which optimizes the air-fuel ratio for the most efficient operation of the engine.

II. Description of the Prior Art

Various methods for controlling the operation of internal combustion engines are known in the art. Today, most of the engines in passenger cars are equipped with exhaust gas oxygen sensors which measure the partial pressure of oxygen in the exhaust. The electrical signals from these exhaust gas oxygen sensors are only indicative if the air-fuel ratio of the air-fuel mixture being supplied to the engine is either rich or lean with reference to a stoichiometric air-fuel ratio in which the air completely oxidizes the fuel leaving little or no oxygen residue. In most closed loop engine control systems, the air-fuel ratio of the air-fuel mixture being supplied to the engine is fairly near to the stoichiometric air-fuel ratio.

Other electronic engine control systems are known in the art which use other engine parameters for closing the loop from the engine to the electronic controller. L. Taplin in U.S. Pat. No. 3,789,816 teaches a lean burn system in which the air flow rate is held constant and the fuel rate is decremented until the engine vibrations reach a predetermined engine roughness. The fuel rate is then dithered to maintain the predetermined engine roughness. The engine roughness in Taplin's patent is measured by a vibration sensor attached to the engine.

C. K. Leung in U.S. Pat. No. 4,344,140 teaches an improvement to Taplin's engine control system in which the engine roughness is determined by measuring the instantaneous rotational velocity of the engine's flywheel. In the fuel control system taught by C. K. Leung, the roughness signal is used as a bias to maintain the engine roughness at a predetermined value.

In a like manner, Latsch in U.S. Pat. No. 4,161,162, Benachi et al in U.S. Pat. No. 4,172,433, and Frolenius in U.S. Pat. No. 4,140,083, all disclose engine control systems in which the fuel delivered to the engine is controlled or adjusted to maintain the fluctuations of the rotational speed of the engine's output at a predetermined value. In an alternate engine control system, Latsch in U.S. Pat. No. 4,064,846, an engine control variable, such as fuel, air or ignition timing is modulated and the phase of the resultant variation in crankshaft acceleration is used to adjust the magnitude of an engine control variable.

SUMMARY OF THE INVENTION

The invention is an engine control system for a heat engine having air delivery means for delivering air to the engine, fuel delivery means for delivering fuel to the engine and an actual engine speed sensor for generating an actual speed signal having a value indicative of the engine's rotational speed. The engine control system has governor means responsive to the actual speed signal for generating a fuel command signal whose value corresponds to a fuel rate determined to maintain the speed of the engine at a desired speed and air-fuel optimization logic means for generating an optimized air-fuel ratio signal having a value optimizing the operating efficiency of the engine. The engine control system further has air control means responsive to the fuel command signal for actuating the air delivery means to deliver air to the engine at an air flow rate corresponding to the value of the product of the fuel command signal and the optimized air-fuel ratio signal and fuel control means for actuating the fuel delivery means in response to the fuel command signal to maintain the actual speed of the engine at the desired speed.

The means for generating the optimized air-fuel ratio generates an air-fuel offset signal which is summed with a reference air-fuel ratio signal to generate the optimized air-fuel ratio signal. The air-fuel offset signal is generated by finding a lean offset and a rich offset at which the fuel command signal generated by the governor means increases by a predetermined percentage. The air-fuel offset signal is the average of the lean and rich offset signals.

The object of the invention is an engine control system in which the air-fuel ratio is optimized for the efficient operation of the engine.

Another object of the invention is an air-fuel ratio optimization logic which is used to generate an offset air-fuel ratio which is summed with a reference air-fuel ratio to generate an optimized air-fuel ratio.

Another object of the invention is an air-fuel optimization logic which is responsive to each change in the fuel command signal generated by a governor to maintain the engine at a predetermined desired speed to generate an air-fuel ratio offset signal.

Another object of the invention is an air-fuel logic in which the air-fuel ratio offset is incremented to find a lean air-fuel offset which causes the governor to increase the fuel delivery rate to the engine by a predeterminable quantity to maintain the engine speed equal to the desired speed and in which the air-fuel ratio offset is decremented to find a rich air-fuel ratio offset which causes the governor to increase the fuel delivery rate to the engine by a predetermined quantity to maintain the engine speed equal to the desired speed.

Another object of the invention is an air-fuel optimization logic in which the air-fuel ratio offset is the average of the lean air fuel offset and the rich air fuel offset.

These and other objects of the invention will become more apparent from reading the specification in conjunction with the drawings.

DETAILED DESCRIPTION OF THE INVENTION AND PREFERRED EMBODIMENT THEREOF

Figure 1:
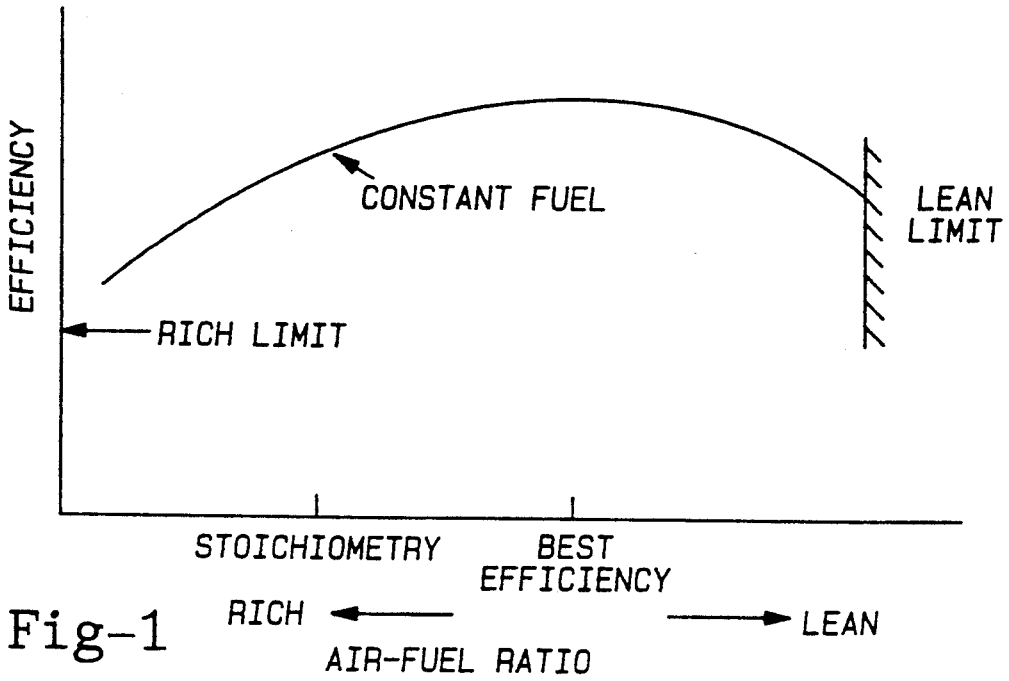
FIG. 1 is a graph showing the efficiency of a typical heat engine as a function of air-fuel ratio.

As illustrated in the graph shown on FIG. 1, the efficiency of a heat engine, such as an internal combustion engine, is a function of the air-fuel ratio and has a maximum value when the air-fuel ratio is greater than a stoichiometric value. It is, therefore, desirable to operate the engine using an air-fuel ratio which gives optimum efficiency in order to reduce the engine's fuel consumption.

Figure 2:
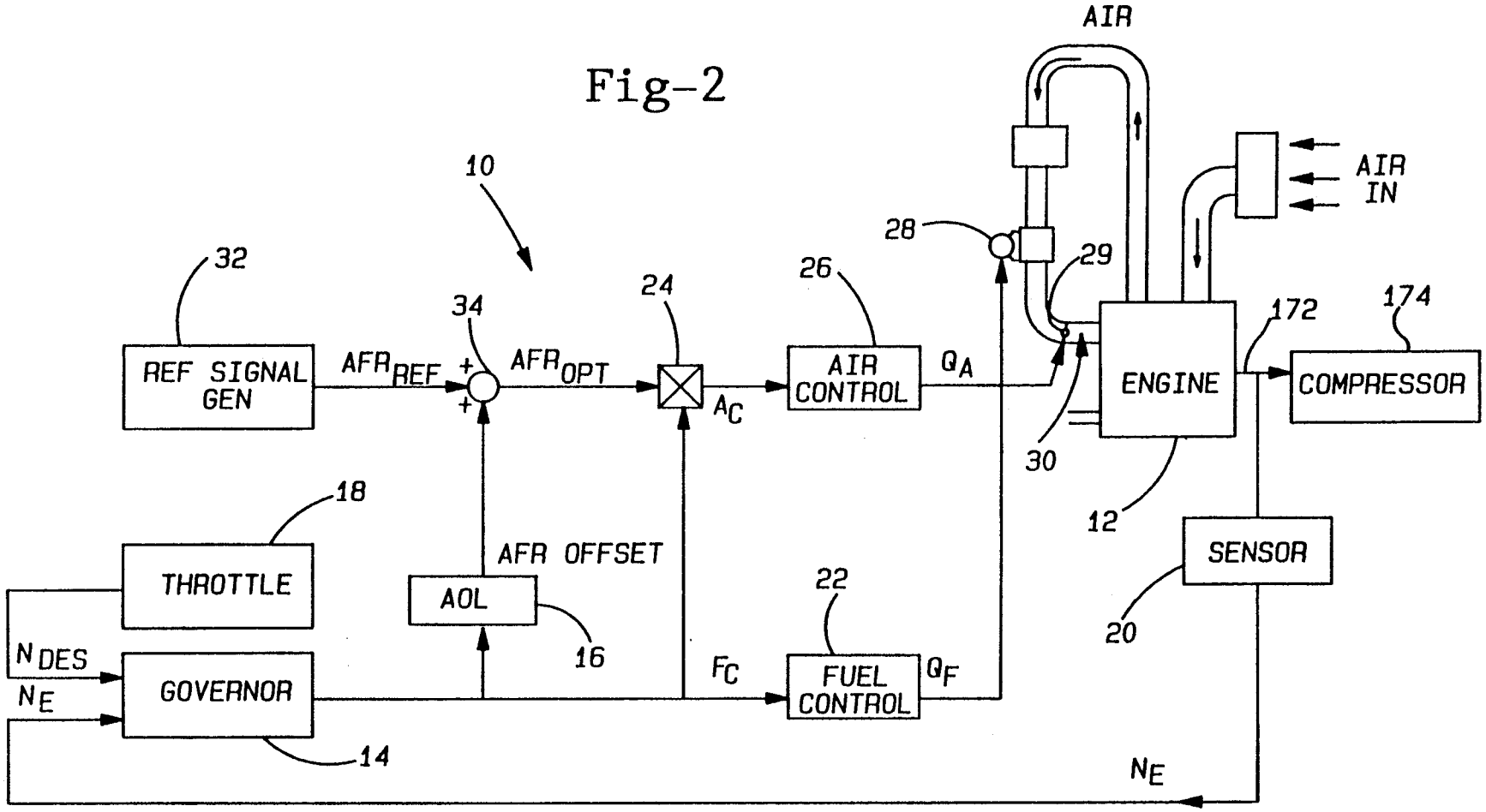
FIG. 2 is a block diagram of an engine control system incorporating an air-fuel optimization logic.

FIG. 2 is a block diagram showing the details of the control system 10 for a heat pump engine 12. The control system 10 includes a isochronous speed governor 14, and air-fuel optimization logic (AOL) 16. The isochronous governor 14 receives a first input signal from a device 18, which is indicative of the desired speed, $N_{DES}$, at which the engine 12 is to operate. The isochronous governor 14 also receives an actual speed signal, $N_E$, indicative of the actual speed of the engine 12 from a sensor 20 monitoring the rotational speed of the engine. The sensor 20 may monitor the rotational speed of the engine's output shaft, ring gear or any other rotating element in the engine, as is known in the art. The function of the governor 14 is to generate a fuel commanded signal $F_C$ indicative of the rate at which fuel is to be delivered to the engine to maintain the actual engine speed, $N_E$, at the desired engine speed, $N_{DES}$. If the actual engine speed $N_E$ decreases due to an increased engine load, the governor 14 will increase the fuel delivery rate to the engine to maintain its actual speed equal to the desired speed. Conversely, if the actual engine speed $N_E$ increases due to a reduction in the engine load, the governor 14 will decrease the fuel delivery rate being supplied to the engine.

The fuel commanded signal $F_C$ is received by a fuel control 22 which generates a fuel quantity signal $Q_F$ activating a fuel delivery device 28, such as a fuel injector to deliver fuel to the engine 12 at a rate corresponding to the fuel commanded signal $F_C$. The fuel commanded signal $F_C$ is also received at a multiplier 24 which multiplies the fuel command signal $F_C$ with an optimized air-fuel ratio signal ($AFR_{OPT}$) to generate an air commanded, $A_C$, signal which is transmitted to an air control 26. The air control 26 generates an air quantity signal $Q_A$ which actuates an air control valve, such as throttle blade 29 located in the air intake manifold 30 of the engine 12, to provide the engine with an air delivery rate required to maintain the optimized air-fuel ratio.

A reference air-fuel ratio signal ($AFR_{REF}$) is generated by a reference signal generator 32 which is transmitted to a sum amplifier 34 which sums the output of the air-fuel optimization logic 16 with the reference air-fuel ratio signal ($AFR_{REF}$) to generate the optimized air-fuel ratio signal ($AFR_{OPT}$) used by the multiplier 24.

The reference air-fuel ratio signal ($AFR_{REF}$) is preferably a stoichiometric air-fuel mixture, or even slightly leaner, to facilitate the starting of the engine prior to correction by the air-fuel optimization logic 16 but may be any value up to 18 or 19.

Figure 3:
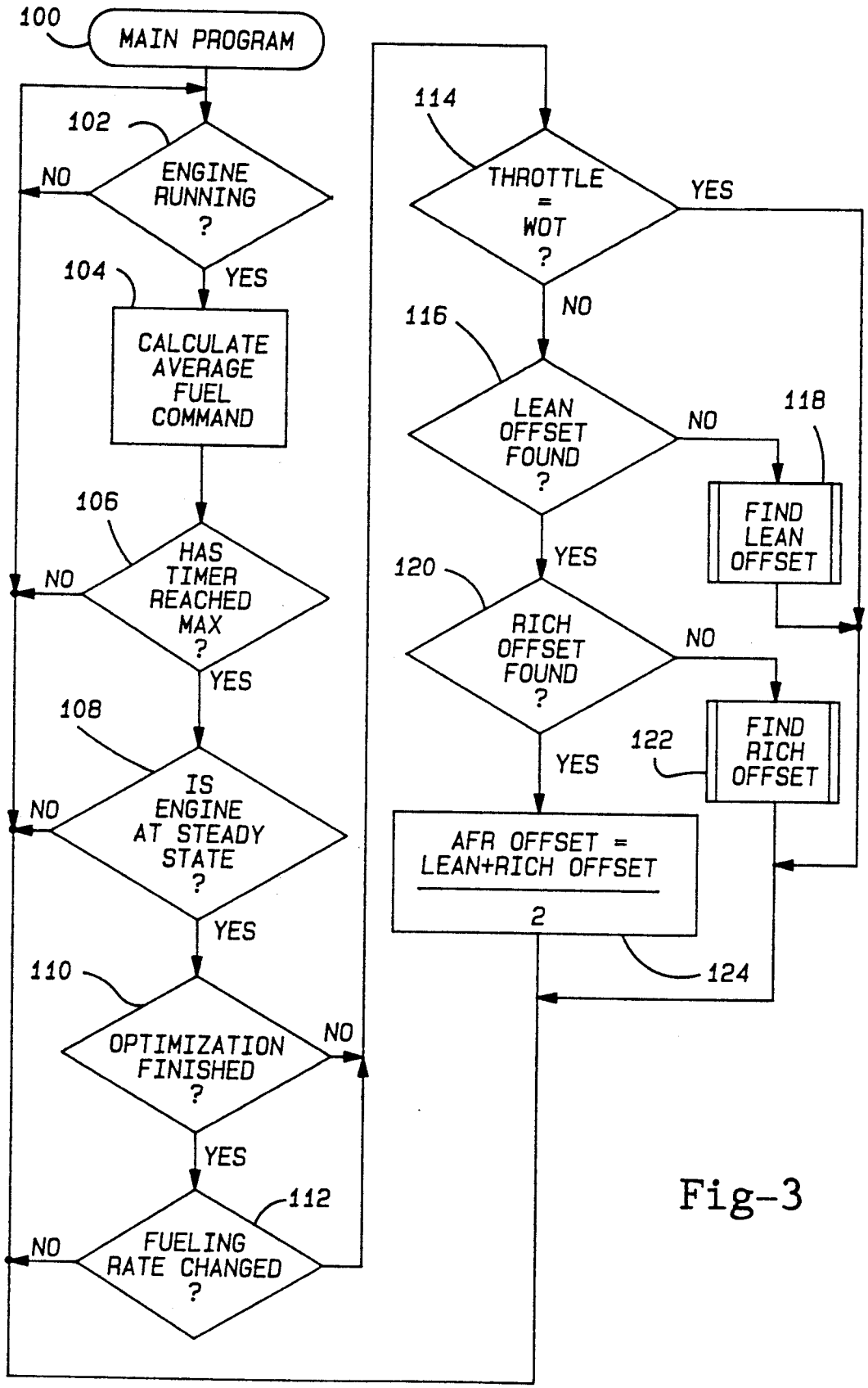
FIG. 3 is a flow diagram of the main program executed by the air-fuel optimization logic.
Figure 4:
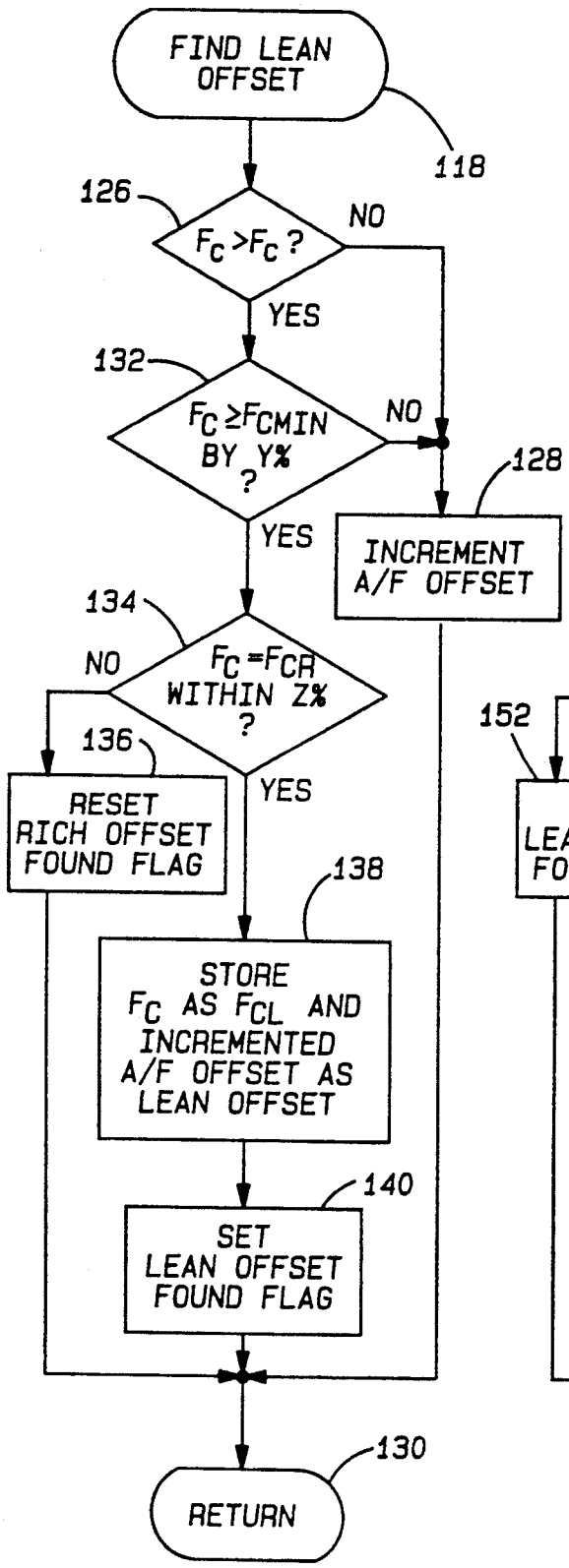
FIG. 4 is a flow diagram of the Find a Lean Offset subroutine.
Figure 5:
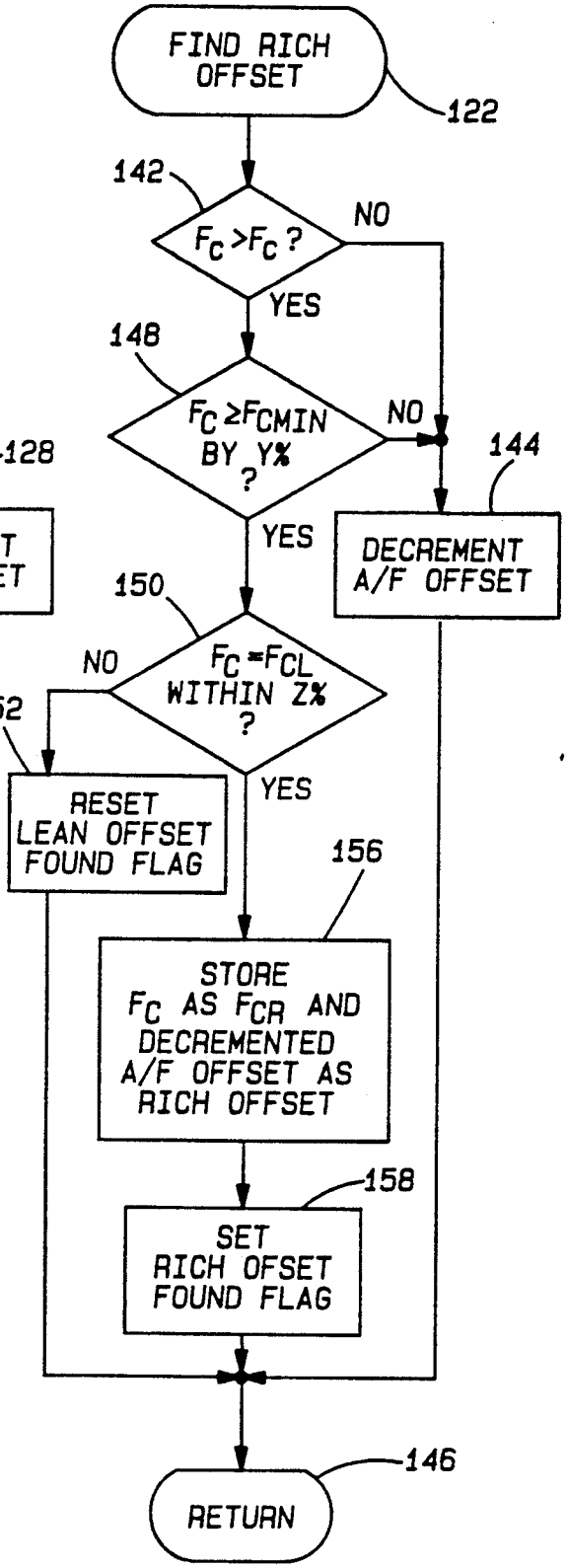
FIG. 5 is a flow diagram of the Find a Rich Offset subroutine.

The air-fuel ratio optimization logic 16 will respond to a change in the fuel commanded signal ($F_C$) to optimize the engine efficiency by increasing or decreasing the value of the reference air-fuel ratio signal, ($AFR_{REF}$), as shall be discussed relative to the flow diagrams shown on FIGS. 3-5. Effectively, the air-fuel ratio optimization logic will generate an offset signal which is summed with reference air-fuel ratio signal in sum amplifier 24 to produce the optimized air-fuel ratio ($AFR_{OPT}$).

Figure 6:
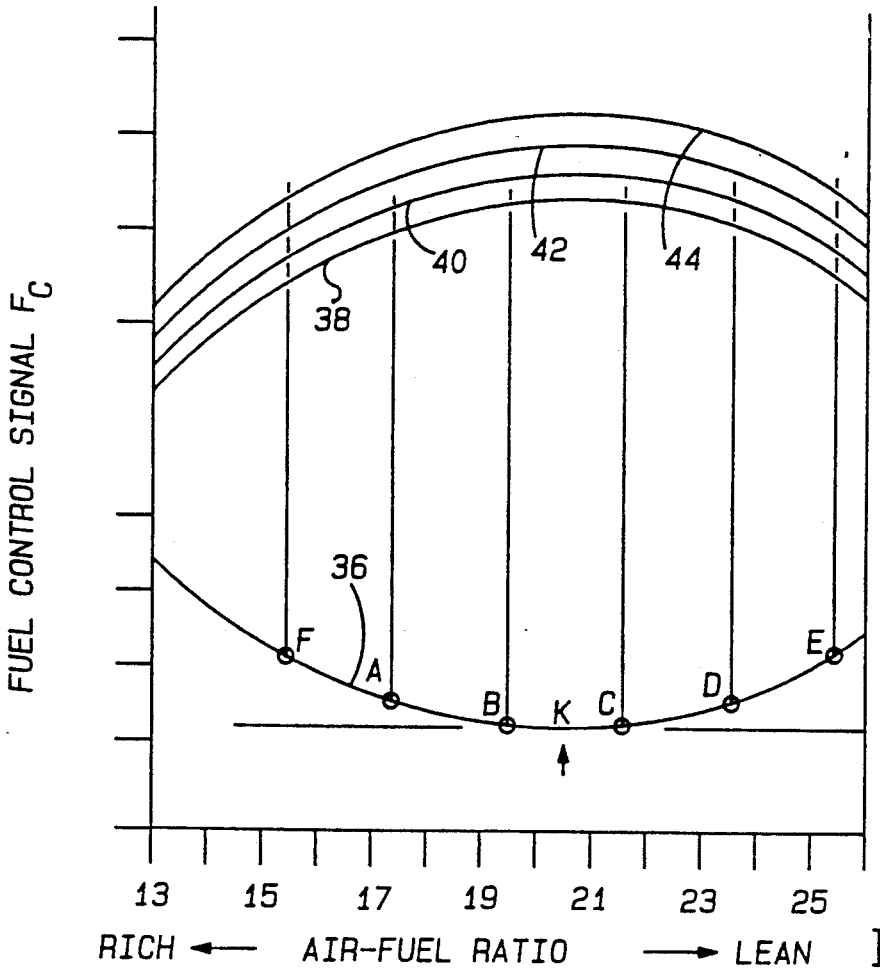
FIG. 6 is a graph showing the change in the fuel flow rate required to maintain the engine at a desired speed as a function of the air-fuel ratio; and FIGS. *7a* through *7c* are a set of graphs showing the actual air-fuel ratio being supplied to the engine, the value of the air-fuel ratio optimized by the air-fuel optimization logic, and the fuel flow rate, respectively, as a function of time.

The operation of the air-fuel ratio optimization logic 16 will first be discussed relative to the main program 100 shown in FIG. 3 and the graph shown on FIG. 6. The main program begins by the air-fuel logic control 16 inquiring if the engine is running as indicated by decision block 102. The fact that the engine is running may be determined by any means known in the art such as the governor 14 generating a fuel command signal or sensor 20 generating a signal which is indicative of an engine speed greater than cranking speed. If the engine is running, then the air-fuel optimization logic will calculate an average of the fuel command signal as indicated in block 104, then inquire, decision block 106, if a start up timer (not shown) has timed out indicating the end of any start-up enrichment that may be used to facilitate the starting of an engine as is known in the art. If the start-up timer has not timed out, the air-fuel optimization logic will return to decision block 102, check to be assured the engine is still running and recalculate the average fuel command. Once the start-up timer has expired, i.e. start-up time=0, the air-fuel optimization logic will inquire if the engine has reached a steady state of operation as indicated by decision block 108. Steady state operation may be indicated by the average of the fuel command signal that has remained substantially constant for predetermined number of calculations or that the engine speed has remained constant for a predetermined period of time.

Once steady state operation has been detected, the air-fuel optimization logic will inquire if an optimization has been completed, as indicated by decision block 110. If an initial optimization has not been executed, the air-fuel optimization logic will execute the optimization routine indicated by blocks 114 to 128 which generates the air-fuel offset signal which is summed with the air-fuel ratio reference signal in sum amplifier 34 to generate the optimized air-fuel ratio, $AFR_{OPT}$. The program will then return to decision block 102 and a new average fuel command will be calculated, as indicated by block 104.

After the initial optimization has been completed, the air-fuel optimization logic will inquire, decision block 112, if the average fuel command signal has changed. If the value of the average fuel command signal has not changed as a result of a new air-fuel ratio offset being computed by the optimization routine, the air-fuel optimization logic will return to block 102 and continue to repeat the routine until a change in the average fuel command is detected resulting from a change in load or a change in one or more operational parameters of the engine, such as a temperature change. If the initial optimization was not executed, decision block 110, or a change in the average fuel command is detected, decision block 112, the air-fuel optimization logic will execute the optimization routine shown in blocks 114 through 124.

The optimization subroutine begins by inquiring if throttle blade 29 is in the wide open throttle (WOT) position. If the throttle blade is in the wide open throttle position, normally indicative that the engine is in an acceleration state, or at a steady-state and a load which requires delivery of fuel in excess of that for optimum efficiency, the optimization routine will not calculate an air-fuel ratio offset and will return to block 102. However, if the throttle blade is not in the wide open throttle position, the air-fuel optimization logic will inquire if a lean offset has been found, as indicated by decision block 116. The lean offset is an air-fuel ratio which requires a predetermined increase in the average fuel command ($F_C$) to maintain the actual engine speed, $N_E$, at the desired engine speed, $N_{DES}$. The lean offset is graphically indicated in FIG. 6 as point E on curve 36. At point E, the fuel control signal has increased by a predetermined percentage, (Y%), from the lowest fuel control signal indicated by points B or C. Curves 38 through 44 show the torque output of the engine 12 for various values of the fuel command signal as a function of air-fuel ratio. As seen, the output torque of the engine 12 has decreased from its maximum value at the air-fuel ratio at point E where the governor 14 had to increase the fuel command by a predetermined value to maintain the actual engine speed at the desired engine speed.

If a lean offset has not been found, the air-fuel optimization logic will execute the Find Lean Offset subroutine 118, shown on FIG. 4, and then return to block 102. After the lean offset has been found, the air-fuel optimization logic will inquire, decision block 120, if a rich offset has been found. If the rich offset has not been found, the air-fuel optimization logic will execute the Find Rich Offset subroutine 122, shown on FIG. 5, and return to block 102. The rich offset is indicated at point F on curve 36 of FIG. 6. The rich offset is determined by fuel control signal increasing by Y% of the minimum fuel control signal indicated at points B or C on curve 36. After both the lean and rich offsets have been found, the air-fuel optimization logic will calculate the $AFR_{OFFSET}$ signal, as indicated by block 124, from the equation:

$$AFR_{OFFSET} = \frac{\text{LEAN OFFSET} + \text{RICH OFFSET}}{2}$$

The $AFR_{OFFSET}$ is calculated to be a value which is half-way between the lean offset and the rich offset. As shall be explained relative to the Find Lean Offset and Find Rich Offset subroutines shown on FIGS. 4 and 5, respectively, the $AFR_{OFFSET}$ is a number indicative of the change in air-fuel ratio from reference air-fuel ratio generated by the reference signal generator 32, which will optimize the efficiency of the engine 12.

After the air-fuel ratio offset ($AFR_{OFFSET}$) has been calculated and summed with the reference air-fuel ratio in sum amplifier 32, the air-fuel optimization logic 16 will continue to monitor the average fuel command signal and will execute the optimization routine when the average fuel command signal changes. In this manner, the air-fuel optimization logic 16 optimizes the efficiency of the engine by changing the air-fuel ratio so that the engine's output torque for a predetermined fuel input rate is near maximum.

The details of the Find Lean Offset subroutine 118 are shown on FIG. 4. This subroutine begins by inquiring, decision block 126, if the average fuel control signal, $F_C$, has increased from its prior value, i.e. $F_{Cn} > F_{Cn-1}$. If it has not, the air-fuel optimization logic 16 will increment the value of the air-fuel offset signal being supplied to the sum amplifier 34 thereby increasing the air-fuel ratio signal output from sum amplifier 34 by a predetermined amount. After incrementing the air-fuel offset, the air-fuel optimization logic will return to the main program as indicated by return block 130. The air-fuel optimization logic 16 will continue to increment the air-fuel offset, as indicated by block 128, until the quantity of fuel indicated by the fuel control signal $F_C$ increases by Y% from a minimum value of the fuel commanded signal $F_C$. As indicated in FIG. 6, if the previously desired air-fuel ratio was at point A on curve 36, a first incrementation of the air-fuel offset would change the air-fuel ratio from point A to point B where the value of $F_C$ is reduced to a minimum fuel control value, $F_{CMIN}$. With continued incrementation of the air-fuel offset, when $F_C$ is not greater than $F_{CMIN}$ by Y%, the fuel control signal will progress from point B through points C and D to point E where the value of the fuel control signal $F_C$ is Y% greater than the minimum fuel control value $F_{CMIN}$. In the preferred embodiment, the air-fuel ratio is increased by 0.5 each time it is incremented. However, the air-fuel ratio may be increased by any other amount each time it is incremented to determine the lean limit. Once the fuel control signal $F_C$ is Y% greater than $F_{CMIN}$, as indicated by block 132, the air-fuel optimization logic will inquire, decision block 134, if the fuel control signal $F_C$ is within Z% of the value of the fuel control signal $F_{CR}$, used to determine the rich air-fuel offset. If $F_C$ is not within Z% of $F_{CR}$, the air-fuel optimization logic will reset a rich offset found flag, as indicated by block 136, indicating a new rich offset has to be found. However, if $F_C$ is within Z% of $F_{CR}$, the air-fuel optimization logic will store $F_C$ as the value of the fuel control signal $F_{CL}$, determined in the finding of the lean offset, and will store the value of the air-fuel ratio offset as the "lean offset", as indicated by block 138, set the lean offset found flag, as indicated by block 140, then return to the main program, as indicated by return block 130.

The lean offset found flag is used by block 116 of the main program, shown on FIG. 3, to determine whether or not the lean offset has been found. The absence of a lean offset flag indicates that a lean offset is to be found, initiating the Find Lean Offset subroutine 118. In a like manner, a rich offset found flag, as shall be discussed relative to the Find Rich Offset subroutine 122 shown on FIG. 5, is used by decision block 120 of the main program to determine whether or not a rich offset has been found. Again, the absence of a rich offset flag indicates a rich offset is to be found, initiating the Find Rich Offset subroutine 122.

FIG. 5 shows the details of the Find Rich Offset subroutine 122. The subroutine begins by inquiring, decision block 142, if the fuel control signal $F_C$ has increased. If the fuel control signal has not increased, the air-fuel optimization logic will decrement the air-fuel offset and return to the main program. This process will be repeated until the fuel control signal $F_C$ has exceeded the minimum fuel control signal $F_{CMIN}$ by at least Y%, as indicated by decision block 148. As shown on FIG. 6, the air-fuel ratio will be decremented towards a richer air-fuel ratio from point E through points D, C, B, A and F. At point F, the fuel control signal $F_C$, necessary to maintain the engine at a constant speed, will increase Y% over the minimum value $F_{CMIN}$ required at points B or C. After $F_C$ exceeds $F_{CMIN}$ by Y%, the air-fuel optimization program will inquire, decision block 150, if the fuel control signal $F_C$ is equal the value of the fuel control signal $F_{CL}$ as used in the Find Lean Offset subroutine 118 shown in FIG. 4 within Z%. If $F_C$ is not equal to $F_{CL}$ within Z%, the air-fuel optimization logic 16 will reset or cancel the lean offset found flag, as indicated by block 152, then return to the main program. The resetting of the lean offset found flag indicates that the operating conditions have changed sufficiently requiring that a new lean offset be found. However, if $F_C$ is equal to $F_{CL}$ within Z%, the air-fuel optimization logic 16 will store $F_C$ as the fuel control signal $F_{CR}$ where the rich offset was found, and will store the value of the decremented air-fuel offset as the rich offset, as indicated by block 156. The air-fuel optimization logic will then set the rich offset found flag, as indicated by block 158, then return to the main program, shown on FIG. 3.

The lean offset found in the Find Lean Offset subroutine 118 and the rich offset found in the Find Rich Offset subroutine 122 are the values used in block 124 of the main program, shown on FIG. 3, to determine the optimized air-fuel ratio offset transmitted to the sum amplifier 34 in the control system, shown on FIG. 2. The above described air-fuel ratio optimization will take place each time there is a change in the engine load which results in the governor 14 changing the value of the fuel control signal $F_C$, as indicated by decision block 112, of the main program.

Figure 7A:
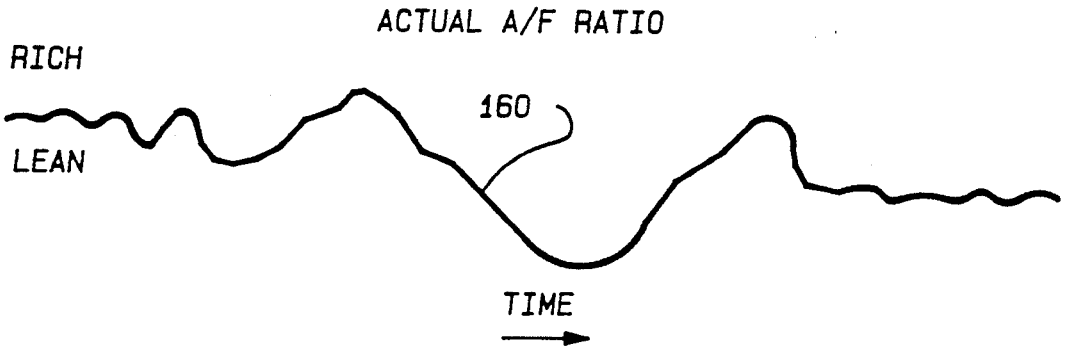
Figure 7B:
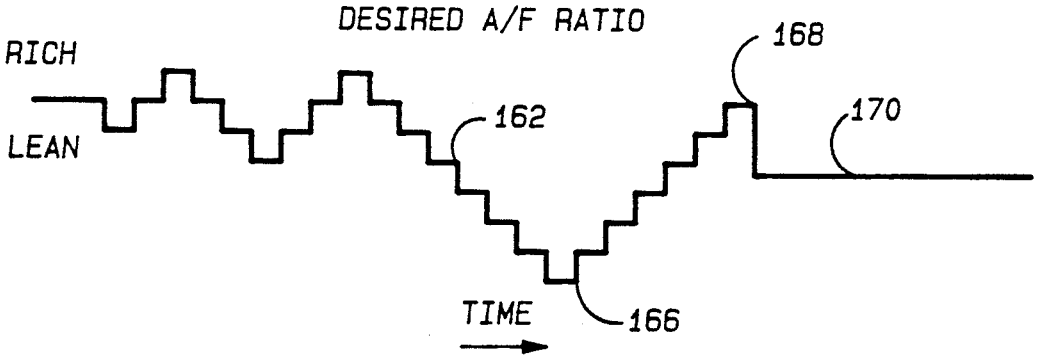
Figure 7C:
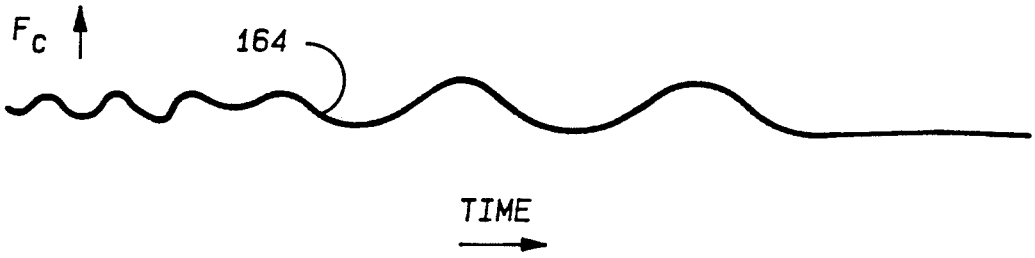

FIG. 7*a* is a graph showing the actual air-fuel ratio curve 160; FIG. 7*b* is a graph showing the optimized air-fuel ratio, curve 162; and, FIG. 7*c* is a graph showing the commanded fuel signal $F_C$, curve 164, as a function of time in an actual air-fuel optimization by the air-fuel optimization logic 16. In the optimized air-fuel ratio curve 162 of FIG. 7*b*, point 166 is the found lean offset and point 168 is the found rich offset. The line segment 170 of the optimized air-fuel ratio curve 162 after the determination of the rich offset, point 168, shows the optimized value of the air-fuel ratio offset which is summed with the reference air-fuel ratio signal in sum amplifier 34 to generate the optimized air-fuel ratio $AFR_{OPT}$. Further tests have shown that the air-fuel optimization logic 16 will maintain the air-fuel ratio between 18 and 21 at engine speeds ranging from 2,400 rpm to 4,800 rpm. This air-fuel ratio range, as shown on FIG. 6, encompasses the air-fuel ratio range in which the engine has maximum efficiency.

In the embodiment shown in FIG. 2, the engine and its attendant fuel control system is part of an integrated engine/air condition or engine/heat pump system in which the rotary output of the engine 172 drives a compressor 174, as shown in FIG. 2.

It is not intended that the invention be limited to the embodiment shown in the drawings and described in the specification. It is recognized that a person skilled in the art may make improvements or changes to the disclosed engine control system and air-fuel ratio logic which are within the spirit of the invention as set forth in the appended claims.

What is claimed is:

1. An engine control system for a heat engine having air delivery means for supply air to said engine, fuel delivery means for supply fuel to said engine, and an actual engine speed sensor generating an actual engine speed signal, said engine control system comprising:

governor means responsive to said actual speed signal for generating a fuel command signal corresponding to a fuel rate determined to maintain the speed of said engine at a desired speed;

air-fuel optimization means for generating an optimized air-fuel ratio signal having a value optimizing the operating efficiency of said engine in response to said fuel command signal;

air control means for actuating said air delivery means to supply air to said engine at an air flow rate corresponding in value of the product of said optimized air-fuel ratio signal and said fuel command signal; and fuel control means for actuating said fuel delivery means to deliver fuel to said engine at said fuel rate determined to maintain said actual speed of said engine at said desired speed.

2. The engine control system of claim 1 wherein said air-fuel optimization means comprises:

means for generating a reference air-fuel ratio signal;

air-fuel optimization logic responsive to said fuel command signal for generating an air-fuel ratio offset signal; and means for summing said air-fuel ratio offset signal with said reference air-fuel ratio signal to generate said optimized air-fuel ratio signal.

3. The engine control system of claim 2 wherein said air-fuel optimization logic comprises:

means for generating an average fuel command value in response to said fuel command signal generated by said governor means;

fuel command detecting means for detecting a change in said average fuel command signal;

means for generating a lean offset signal in response to said fuel command detecting means detecting a change in said fuel command signal;

means for generating a rich offset signal in response to said fuel command detecting means detecting a change in said fuel command signal; and means for generating said air-fuel ratio offset signal from said lean offset signal and said rich offset signal.

4. The engine control system of claim 3 wherein said means for generating said air-fuel offset signal comprises means for generating said air-fuel offset signal having a value equal to the average of said lean offset signal and said rich offset signal.

5. The engine control system of claim 3 wherein said means for generating said lean offset signal comprises:

means for incrementing said air-fuel ratio offset signal in response to said fuel command detecting means detecting a change in said fuel command signal;

means for terminating the incrementing of said air-fuel ratio offset in response to said fuel command signal increasing by a predetermined percentage of a minimum value to generate a lean fuel command signal;

means for comparing the value of said lean fuel command signal with a predeterminable value to determine a difference in the values; and means for storing the value of said incremented air-fuel offset signal as said lean offset signal in response to the values of said lean fuel command signal and said predetermined value being within a predetermined percentage of each other.

6. The engine control system of claim 5 wherein said means for generating said rich offset signal comprises:

means for decrementing said air-fuel ratio offset signal in response to said command signal detection means detecting a change in said command signal;

means for terminating the decrementing of the value of said air-fuel ratio offset signal in response to the value of said fuel command signal increasing by said predetermined percentage of said minimum value to generate a rich fuel command signal;

means for comparing the value of said rich fuel command signal to the value of said lean fuel command signal to determine a difference in their values; and means for storing the value of said decremented air-fuel offset signal as said rich offset signal in response to the values of said lean offset and said rich offset being within said predetermined percentage of each other.

7. The engine control system of claim 6 wherein said predeterminable value of said means for generating a lean offset signal is the value of said rich fuel command signal.

8. The engine control system of claim 7 wherein said means for generating a lean offset signal includes a lean offset found flag indicating a value of said lean offset has been found and means for setting said lean offset flag in response to said difference in the values of said lean offset signal and said rich offset signal being less than said predetermined percentage of the value of said lean offset signal, and wherein said means for generating said rich offset signal includes a rich offset found flag indicating a value of said rich offset signal has been found and means for setting said rich offset flag in response to said difference in the values of said lean offset signal and said rich offset signal being within said predetermined percentage of each other.

9. The engine control system of claim 8 wherein said means for generating a lean offset signal includes means for resetting said rich offset found flag in response to said difference between the value of said lean fuel command signal and the value of said rich fuel command signal being greater than said predetermined percentage and wherein said means for generating a rich offset signal includes means for resetting said lean offset found flag in response to said difference between the value of said rich fuel command signal and the value of said lean fuel command signal being greater than said predetermined percentage.

10. A method for controlling the air-fuel ratio of a heat engine to optimize its efficiency, said heat engine having an air delivery means for supplying air to said engine, fuel delivery means for delivering fuel to said engine, and an engine speed sensor generating an actual engine speed signal, said method comprising the steps of:

generating a fuel command signal corresponding to a fuel rate determined to maintain said actual engine speed at a desired engine speed;

generating an optimized air fuel ratio signal in response to said fuel command signal, said optimized air-fuel ratio signal having a value optimizing the operating efficiency of the engine;

actuating said air delivery means to supply air to said engine at an air flow rate corresponding in value to the product of said optimized air-fuel ratio signal and said fuel command signal; and actuating said fuel delivery means to deliver fuel to said engine in response to said fuel command signal, said fuel delivery means delivering fuel to said engine at a flow rate determined to maintain said actual engine speed as said desired engine speed.

11. The method of claim 10 wherein said step of generating an optimized air-fuel ratio comprises the steps of:

generating a lean offset signal in response to detecting a change in said fuel command signal;

generating a rich offset signal in response to detecting said change in said fuel command signal; and generating said air-fuel ratio offset signal from the values of said lean offset and rich offset signals.

12. The method of claim 11 wherein said step of generating said air-fuel ratio offset signal comprises the step of generating said air-fuel ratio offset signal having a value which is the average of the values of said lean offset and rich offset signals.

13. The method of claim 11 wherein said step of generating said lean offset signal comprises the steps of:

incrementing said air-fuel ratio offset signal in response to the value of said fuel command signal changing by less than a first predetermined percentage;

terminating the incrementing of said air-fuel offset signal in response to the value of said fuel command signal changing by more than said first predetermined percentage, said fuel command signal changed by more than said first predetermined percentage being a lean fuel command signal;

comparing the value of said lean fuel command signal to a predeterminable value to determine a difference in their values; and storing the value of said incremented air-fuel offset signal as said lean offset signal in response to said difference in the values of said lean fuel command signal and said predeterminable value being less than a second predetermined percentage.

14. The method of claim 13 wherein said step of generating a rich offset signal comprises the steps of:

decrementing said air-fuel ratio offset signal in response to the value of said fuel command signal changing by less than said first predetermined percentage;

terminating the decrementing of said air-fuel ratio offset signal in response to said fuel command signal changing by more than said first predetermined percentage, said fuel command signal changed by said first predetermined percentage being a rich fuel command signal;

comparing the value of said rich fuel command signal to the value of said lean fuel command signal to determine a difference in their values; and storing the value of said decremented air-fuel offset signal as said rich offset signal in response to said difference in the values of said rich fuel command and lean fuel command signals being less than said second predetermined percentage.

15. The method of claim 14 wherein said step of comparing the value of said lean fuel command signal to a predeterminable value compares said lean fuel command signal to said rich fuel command signal.

16. The method of claim 15 wherein said step of generating a lean offset signal further includes the steps of:

setting a lean offset found flag in response to said difference in the values of said lean and rich fuel command signals being less than said second predetermined percentage; and resetting a rich offset found flag in response to said difference in the values of said lean and rich fuel command signals being greater than said second predetermined percentage; and wherein said step of generating a rich offset signal further includes the steps of:

setting said rich offset found flag in response to said difference in the values of said lean and rich fuel command signals being less than said second predetermined percentage; and resetting said lean offset found flag in response to said difference in the values of said lean and rich fuel command signals being greater than said second predetermined percentage.

17. An air-fuel optimization logic for optimizing the operation of a heat engine having a governor for generating a fuel command signal corresponding to a fuel flow rate required to maintain the engine speed at a desired speed, means for generating a reference air-fuel ratio signal, and means responsive to said fuel command signal and said air-fuel ratio signal for supplying air to said engine wherein the air fuel ratio of said air and fuel being supplied to said engine is equal to said reference air-fuel ratio, said air-fuel optimization logic comprising:

means responsive to said fuel command signal for generating an air-fuel ratio offset signal which when summed with said air-fuel ratio signal generates an optimized air-fuel ratio signal which optimizes the efficiency of operation of said engine; and means for summing said air-fuel offset signal to said air-fuel reference signal to generate said optimized air-fuel ratio signal.

18. The air-fuel optimization logic of claim 17 wherein said means for generating an air-fuel ratio offset signal comprises:

means for generating a lean offset signal in response to a change in said air-fuel command from an average fuel command;

means for generating a rich offset signal in response to a change in said air-fuel command from an average fuel command; and means for generating said air-fuel ratio offset signal from said lean offset and said rich offset signals.

19. The air-fuel optimization logic of claim 18 wherein said means for generating said air-fuel ratio offset signal comprises means for generating said air-fuel ratio offset signal having a value which is an average of the value of said lean offset signal and the value of said rich offset signal.

20. The air-fuel optimization logic of claim 19 wherein said means for generating said lean offset signal comprises:

means for incrementing said air-fuel ratio offset signal in response to detecting a change in said fuel command signal;

means for terminating the incrementing of said air-fuel ratio offset signal in response to said fuel command signal increasing by a first predetermined percentage of a minimum value, said increased fuel command signal being a lean fuel command signal;

means for comparing the value of said lean fuel command signal with a predeterminable value to generate a difference signal; and means for storing the value of said incremented offset signal as said lean offset signal in response to said difference signal being less than a second predetermined percentage.

21. The air-fuel optimization logic of claim 20 wherein said means for generating a rich offset signal comprises:

means for decrementing said air-fuel ratio offset in response to detecting a change in said fuel command signal;

means for terminating the decrementing of said air-fuel ratio offset signal in response to said fuel command signal increasing by said first predetermined percentage of a minimum fuel command signal, the value of said increased fuel command signal being a rich fuel command signal;

means for comparing the value of said rich fuel command signal with said lean fuel command signal to generate a difference signal; and means for storing the value of said decremented offset signal as said rich offset signal in response to said difference signal being greater than a predetermined percentage of each other.

22. The air-fuel optimization logic of claim 21 wherein said predeterminable value is said rich fuel command signal.

23. The air-fuel optimization logic of claim 22 further including a lean offset found flag indicating a lean offset has been determined and a rich offset found flag indicating that said rich offset has been determined, said means for generating a lean offset signal further includes:

means for setting said lean offset found flag in response to said difference signal being less than said second predetermined percentage; and means for resetting said rich offset found flag in response to said difference signal being greater than said second predetermined percentage; and wherein said means for generating a rich offset signal further includes;

means for setting said rich offset found flag in response to said difference signal being less than said second predetermined percentage; and means for resetting said lean offset found flag in response to said difference signal being greater than said second predetermined percentage.

24. A method for optimizing the operation of a heat engine having a governor for generating a fuel command signal corresponding to a fuel flow rate required to maintain the engine speed at a desired speed, means for generating a reference air-fuel ratio signal, and means responsive to said fuel command signal and said air-fuel ratio signal for supplying air to said engine, said method comprising the steps of:

generating an air-fuel ratio offset signal in response to said fuel command signal; and summing said air-fuel ratio offset signal to said air-fuel reference signal to generate an optimized air-fuel reference signal optimizing the efficiency of said engine.

25. The method of claim 24 wherein said step of generating an air-fuel ratio offset signal comprises the steps of:

generating a lean offset signal in response to a change in said air-fuel command from an average fuel command;

generating a rich offset signal in response to a change in said air-fuel command from an average fuel command; and generating said air-fuel ratio offset signal from said lean offset and said rich offset signals.

26. The method of claim 25 wherein said step of generating said air-fuel ratio offset signal comprises the step of averaging the value of said lean offset signal and the value of said rich offset signal.

27. The method of claim 26 wherein said step of generating said lean offset signal comprises the steps of:

incrementing said air-fuel ratio offset signal in response to detecting a change in said fuel command signal;

terminating the incrementing of said air-fuel ratio offset signal in response to said fuel command signal increasing by a first predetermined percentage of a minimum value, said increased fuel command signal being a lean fuel command signal;

comparing the value of said lean fuel command signal with a predeterminable value to generate a difference signal; and storing the value of said incremented offset signal as said lean offset signal in response to said difference signal being less than a second predetermined percentage.

28. A method of claim 27 wherein said step of generating a rich offset signal comprises the steps of:

decrementing said air-fuel ratio offset in response to detecting a change in said fuel command signal;

terminating the decrementing of said air-fuel ratio offset signal in response to said fuel command signal increasing by said first predetermined percentage of a minimum fuel command signal, the value of said increased fuel command signal being a rich fuel command signal;

comparing the value of said rich fuel command signal with said lean fuel command signal to generate a difference signal; and storing the value of said decremented offset signal as said rich offset signal in response to said difference signal being greater than a predetermined percentage of each other.

29. The method of claim 28 wherein said predeterminable value is said rich fuel command signal.

30. The method of claim 29 wherein said step of generating a lean offset signal further includes the steps of:

setting a lean offset found flag in response to said difference signal being less than said second predetermined percentage; and resetting a rich offset found flag in response to said difference signal being greater than said second predetermined percentage; and wherein said step of generating a rich offset signal further includes the steps of:

setting said rich offset found flag in response to said difference signal being less than said second predetermined percentage; and resetting said lean offset found flag in response to said difference signal being greater than said second predetermined percentage.

* * * * *